US006150624A

United States Patent [19]

Yao

[11] Patent Number: 6,150,624

[45] Date of Patent: Nov. 21, 2000

[54] KEYSWITCH DEVICE

[75] Inventor: Huan-Ming Yao, Tao-Yuan, Taiwan

[73] Assignee: Hon Hai Precision Ind. Co., Ltd., Taipei Hsien, Taiwan

[21] Appl. No.: 09/400,709

[22] Filed: Sep. 21, 1999

[30] Foreign Application Priority Data

Dec. 31, 1998 [TW] Taiwan ..... 87222051

[51] Int. Cl.[7] ..... H01H 13/70; H01H 3/12

[52] U.S. Cl. ..... 200/344

[58] Field of Search ..... 200/5 A, 517, 200/344, 345; 400/490, 491, 491.2, 495, 495.1, 496

[56] References Cited

U.S. PATENT DOCUMENTS 5,625,532 4/1997 Sellers ..... 361/680
5,743,383 4/1998 Yano et al. ..... 200/344
5,850,194 12/1998 Lin ..... 341/22
5,901,837 5/1999 Aimi ..... 200/344

*Primary Examiner*—Michael Friedhofer
*Attorney, Agent, or Firm*—Wei Te Chung

[57] ABSTRACT

A keyswitch device consists of a keycap, a supporting plate, a switch, a first hinge member and a second hinge member. The supporting plate is arranged under the keycap and forms a tag defining an aperture, and a tab opposite the tag. The first hinge member has a planar portion and a biased portion angled from the planar portion. The planer portion defines an engaging hole therein and extends into the aperture of the tag. The engaging hole of the planar portion is locked by the tab. The first hinge member further forms shaft rods pivotably engaging the second hinge member, and engaging rods slidably received in the keycap. When the keycap is downwardly depressed, the switch is actuated to conduct a switch action. The biased portion is resiliently deflectable to the planar portion. The second hinge member pivotally connects between the supporting plate and the keycap.

15 Claims, 5 Drawing Sheets

KEYSWITCH DEVICE

BACKGROUND OF THE INVENTION

The present invention relates to a keyswitch device, and particularly to a keyswitch device of excellent operability which can be easily assembled.

A keyboard is commonly used as an input device for a word processor or a personal computer. A plurality of keyswitch devices is arranged on a top surface of the keyboard. Each keyswitch device includes a keycap for being downwardly pressed and a stem projecting from a bottom surface of the keycap. A guiding hole corresponding to each keyswitch is defined in the top surface of the keyboard and receives the stem of the keyswitch. A spring is arranged in the guiding hole for upwardly pressing against the keycap. The stem of the keyswitch device is movably disposed in the guide hole. However, the stem of the keyswitch is likely to become stuck in operation if the stem is not long enough. Furthermore, such a keyswitch is incapable of promoting a miniaturization trend of the keyboard.

In order to overcome the disadvantages described above, compact keyswitch devices have been disclosed in U.S. Pat. Nos. 5,457,297; 4,433,255; 5,399,822; 5,278,371; 5,382,762; 5,466,901 and 5,278,372. Such a keyswitch device replaces the stem of the keycap and the guide hole with a guide support member. The guide support member has a pair of engaged hinge members pivotally connected to both the keycap and the top surface of the keyboard. However, the guide support member has a complex structure thereby complicating assembly. In addition, a pivotal connecting portion for linking the guide support member and the top surface of the keyboard is unstable during operation. Therefore, a keyswitch having a simple structure and stable operation is desired.

SUMMARY OF THE INVENTION

Accordingly, a primary object of the present invention is to provide a smoothly functioning keyswitch device.

A second object of the present invention is to provide a keyswitch device which has a simple structure and can be easily assembled.

To fulfill the above-mentioned objects, a keyswitch device comprises a keycap, guide support means, switching means and a supporting plate. The keycap includes a pair of first retention members and a pair of second retention members. The supporting plate arranged under the keycap forms a third retention member diagonally corresponding to the first retention members and a pair of fourth retention members diagonally corresponding to the second retention members. The third retention member includes a tag defining an aperture and a tap. The guide support means includes a first hinge member and a second hinge member. The first hinge member has a first engaging portion including a pair of engaging rods for pivotally engaging with the first retention members and a second engaging portion including a planar portion defining an engaging hole therethrough. The planar portion extends into the aperture of the tag and the engaging hole of the planar portion is locked by the tab thereby securing the third retention member and the second engaging portion together. The second hinge member has a third engaging portion including a pair of second engaging rods for pivotally engaging with the second retention members and a fourth engaging portion including a pair of third engaging rods for slidably engaging with the fourth retention means. The switch means conducts a switching action according to movement of the keycap.

DETAILED DESCRIPTION OF THE INVENTION

Figure 1:
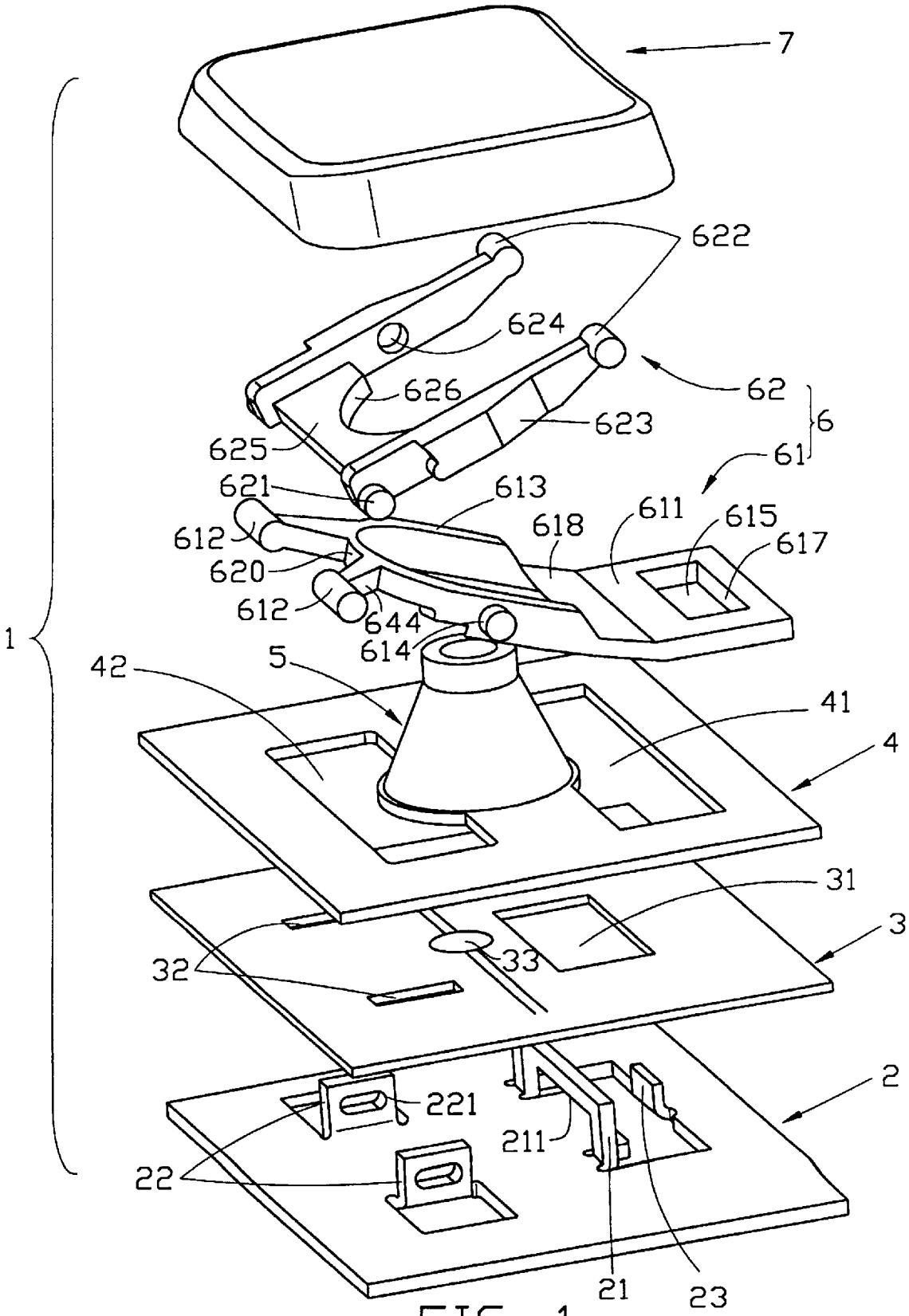
FIG. 1 is an exploded view of a keyswitch device in accordance with the present invention.
Figure 2:
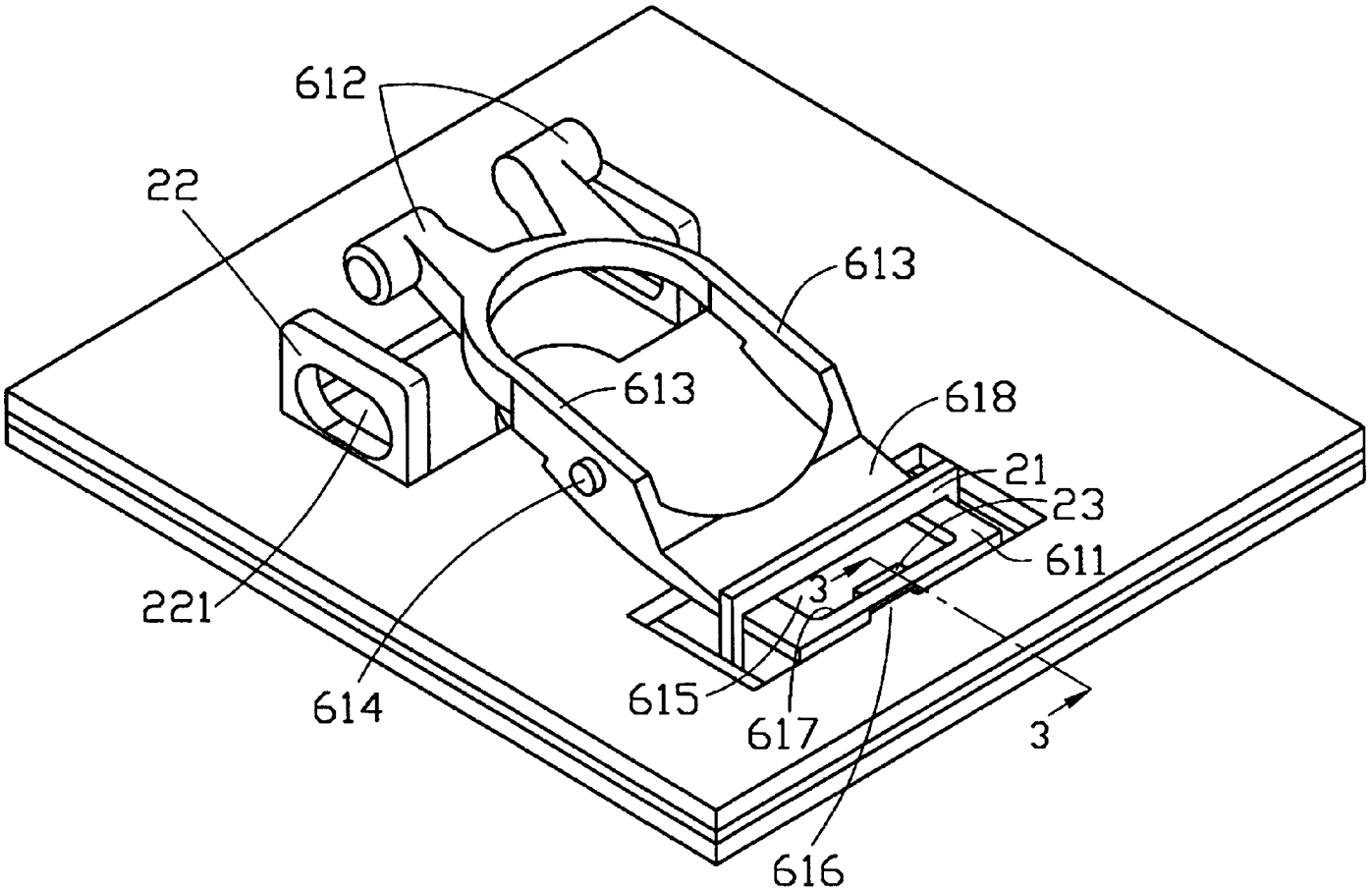
FIG. 2 is a perspective view of the keyswitch device of the present invention with a keycap, a second hinge member and a rubber spring removed for facilitating description thereof.
Figures 3A, 3B, 3C, 3D:
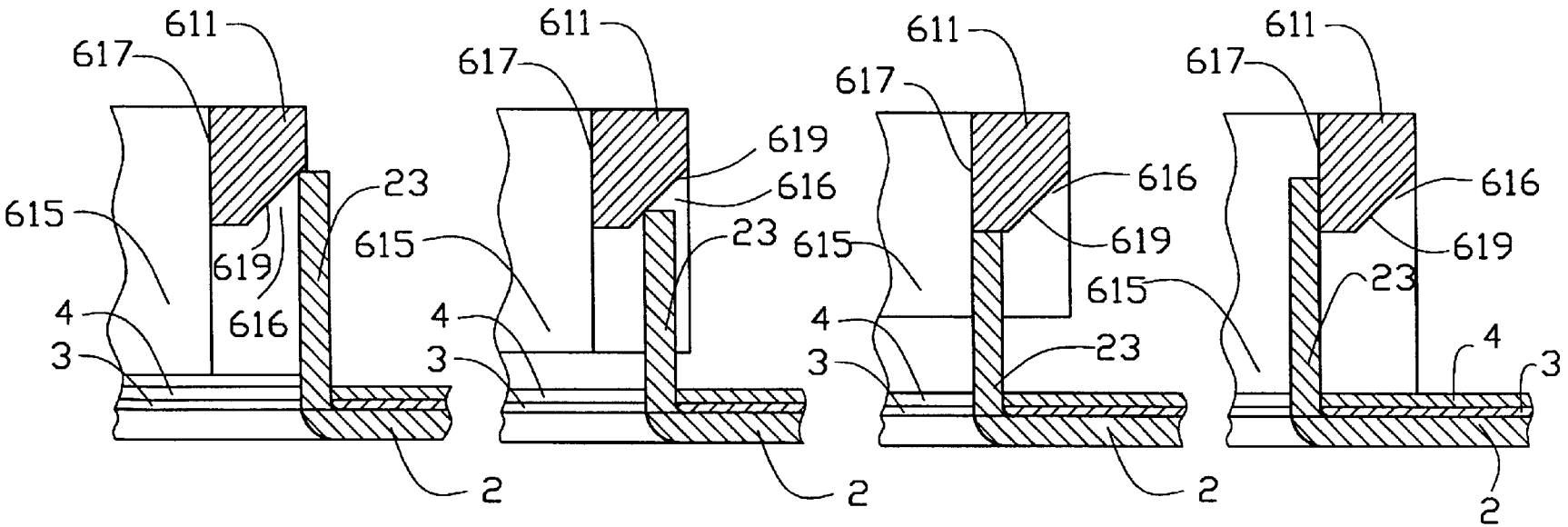
FIGS. 3A–3D are partial, cross-sectional views of the keyswitch device of the present invention taken along line 3—3 of FIG. 2 showing different states in order to describe an assembly process of a tab and an end portion.

Referring to FIG. 1, a keyswitch device 1 in accordance with the present invention comprises a keycap 7, guide support means 6, a base plate 4, a flexible circuit board 3 and a supporting plate 2.

Figure 4:
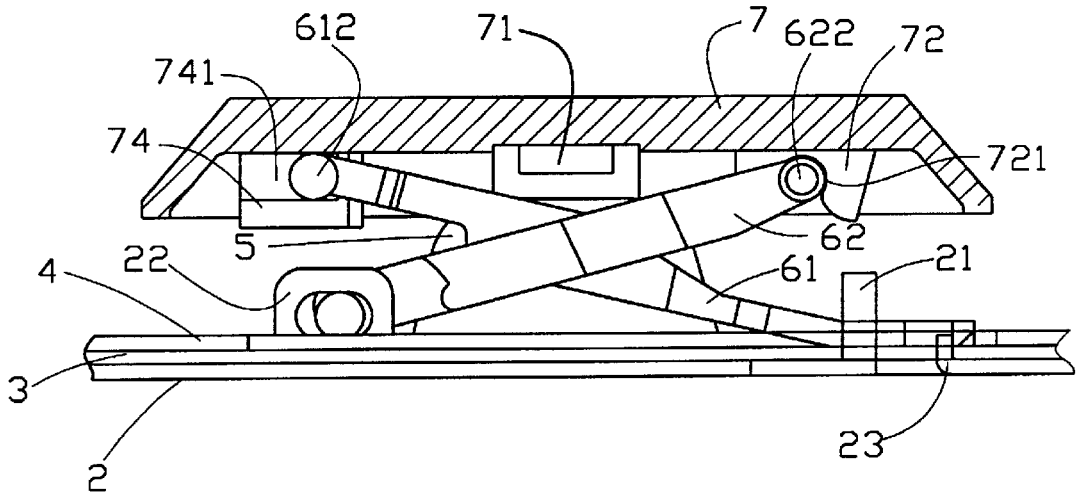
FIG. 4 is a side view of an assembled keyswitch device of the present invention.

Also referring to FIG. 4, the keycap 7 includes a pair of first retention members 74 and a pair of second retention members 72. The first and second retention members 74, 72 downwardly extend from a bottom surface of the keycap 7. Each first retention member 74 defines a retention slot 741 exposed to an end thereof. Each second retention member 72 defines a round recess 721 therein. A post 71 downwardly extends from the bottom surface of the keycap 7.

The supporting plate 2 includes a pair of ears 22 formed by stamping and bending the supporting plate 2 to diagonally correspond with the second retention members 72 of the keycap 7. Each ear 22 defines an engaging slot 221. An inverted U-shaped tag 21 and a tab 23 opposite the tag 21 are formed by stamping and bending the supporting plate 2 to diagonally correspond with the first retention members 74 of the keycap 7. The tag 21 defines a substantially rectangular aperture 211 therethrough.

The flexible circuit board 3 arranged above the supporting plate 2 has a fixed electrode 33 at a center thereof. The flexible circuit board 3 defines a pair of slits 32 corresponding to the ears 22 of the supporting plate 2 and a substantially rectangular opening 31 corresponding to the tag 21 and the tab 23.

The base plate 4 arranged above the flexible circuit board 3 defines a first elongate opening 42 corresponding to the ears 22 and a second elongate opening 41 corresponding to the tag 21 and tab 23. A rubber spring 5 having a movable electrode (not shown) therein is disposed on the base plate 4 corresponding to the fixed electrode 33 of the flexible circuit board 3.

The ears 22 of the supporting plate 2 extend through the slits 32 of the flexible circuit board 3 and the first elongate opening 42 of the base plate 4. The tag 21 and the tab 23 of the supporting plate 2 extend through the rectangular opening 31 of the flexible circuit board 3 and the second elongate opening 41 of the base plate 4. Thus, the supporting plate 2, the flexible circuit board 3 and the base plate 4 are vertically aligned.

Also referring to FIGS. 2, 3A to 3D, the guide support means 6 includes a first hinge member 61 and a second hinge member 62. The first hinge member 61 has a planar portion 611 defining a rectangular engaging hole 615 therein and a biased portion 618 angled from the planar portion 611. An elongate groove 616 corresponding to the tab 23 of the supporting plate 2 is defined in an edge of the planar portion 611. An inclined inner surface 619 is formed in the groove 616. A pair of plates 613 extends from the biased portion 618 and are linked together by a middle portion 620. A shaft rod 614 projects from an outer surface of each plate 613. A pair of arms 644 extends from the middle portion 620. An engaging rod 612 is formed at a distal end of each arm 644.

To assemble the first hinge member 61 to the keyswitch device 1, the planar portion 611 extends through the rectangular aperture 211 of the tag 21. A distal end of the tab 23 downwardly slides along the inclined surface 619 of the groove 616 and moves into the rectangular engaging hole 615 of the first hinge member 61. A side surface of the tab 23 closely abuts against an inner edge 617 of the planar portion 611 thereby securing the first hinge member 61 in the aperture 211 of the supporting plate 2. The engaging rods 612 are slidably received in the retention slots 741 of the keycap 7.

The second hinge member 62 includes a center portion 625 and a pair of parallel rods 623 extending from opposite ends of the center portion 625. An inner side of the center portion 625 forms an arcuate surface 626 for facilitating extension of the rubber spring 5 therethrough. A first engaging pin 621 projects from one end of each parallel rod 623 proximate the center portion 625 and a second engaging pin 622 projects from an opposite end thereof. A round hole 624 is defined in an inner surface of each parallel rod 623 corresponding to the shaft rod 614 of the first hinge member.

To assemble the second hinge member 62 to the keyswitch device 1, the first engaging pins 621 are slidably received in the engaging slots 221 of the supporting plate 2. The second engaging pins 622 are pivotally received in the round recesses 721 of the keycap 7. The shaft rods 614 of the first hinge member 61 are pivotally received in the round holes 624 of the second hinge member 62 such that the first and second hinge members 61, 62 are pivotally engaged together.

When the keycap 7 is downwardly depressed, the engaging rods 612 of the first hinge member 62 slide into the retention slot 741 of the keycap 7 from a lateral direction. The biased portion 618 is downwardly deflected and the planar portion 611 functions as a fulcrum. The first engaging pins 621 of the second hinge member 62 slide in the engaging slots 221 of the supporting plate 2 towards a lateral direction. The second engaging pins 622 pivotally engage in the round recesses 721 of the keycap 7. The post 71 of the keycap 7 downwardly moves and gradually presses the rubber spring 5. When the pressing force by the post 71 exceeds a predetermined value, the rubber spring 5 buckles. Thus, the movable electrode of the rubber spring 5 contacts the fixed electrode 33 on the flexible circuit board 3 and a switching action is conducted.

When the keycap 7 is released, the biased portion 618 of the first hinge member 61 moves upwardly back to its original position, due to an elastic restoring force thereof. Accordingly, the engaging rod 612 of the first hinge member 61, and the first and second engaging pins 621, 622 of the second hinge member 62 return to their original positions. Thus, the keycap 7 also returns to its pre-depressed position.

Since the first hinge member 61 is not pivotally connected to the supporting plate 2 as disclosed in the prior art, the structure of the keyswitch 1 is simplified. Thus, assembly of such a keyswitch 1 is time and cost efficient. Furthermore, when the keycap 7 is released, the biased portion 618 of the first hinge member 61 moves upwardly due to an elastic restoring force thereof thereby providing a smooth vertical movement of the keycap 7.

It should be understood that the shaft rods 614 of the first hinge member 61 can be replaced with a pair of round recesses while the round recesses 624 of the second hinge member 62 can be replaced with a pair of shaft rods.

Figure 5:
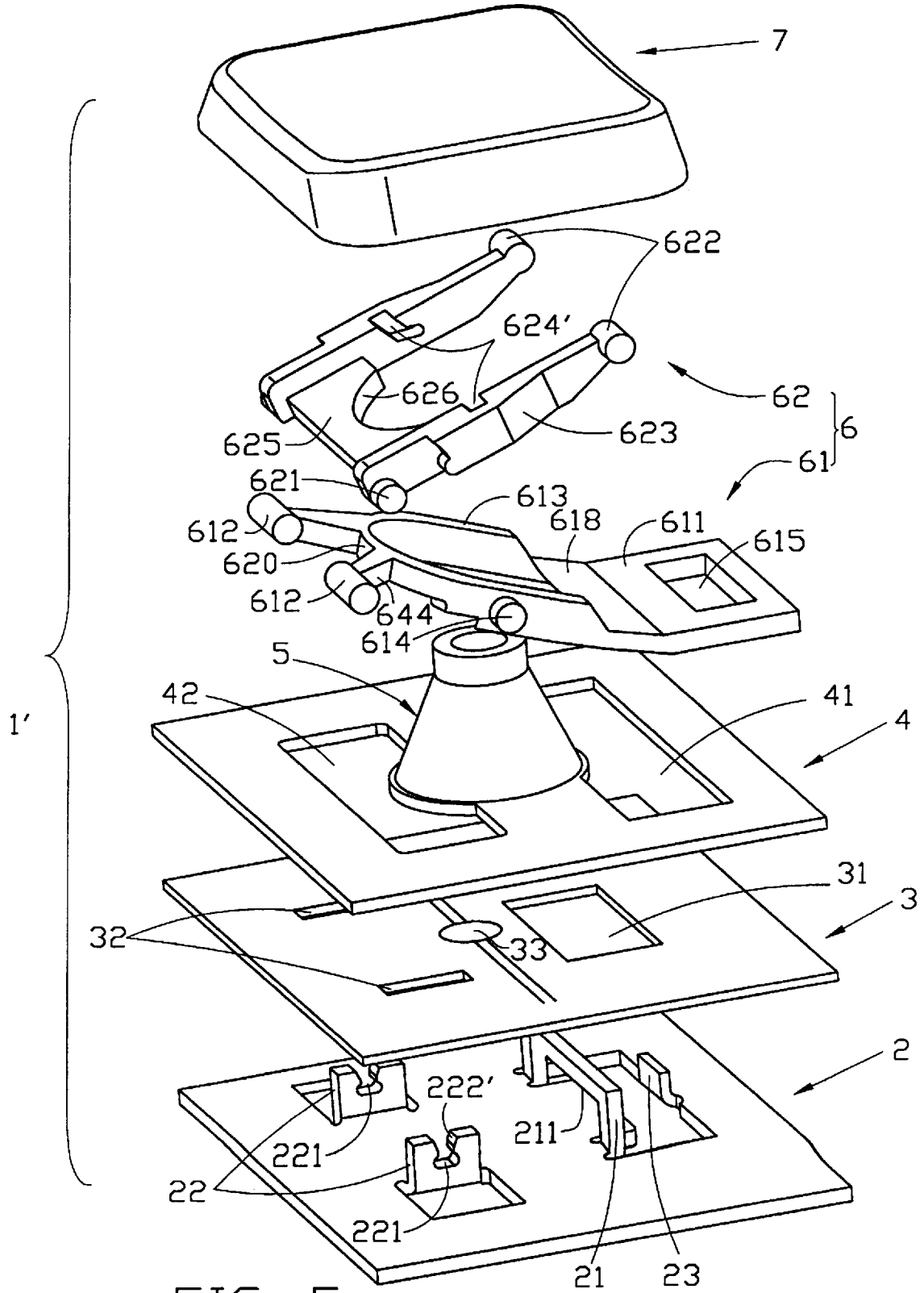
FIG. 5 is an exploded view of a keyswitch device of an alternative embodiment.

FIG. 5 shows a keyswitch device 1' of an alternative embodiment of the present invention. The differences between the two embodiments reside in the rods 623 of the second hinge member 62 and the ears 22 of the supporting plate 2. Thus, like numerals have been applied in FIG. 5 to designate like components of the keyswitch 1' which correspond to those components already described above in relation to the keyswitch 1 of FIG. 1.

Each rod 623 of the second hinge member 62 defines a substantially L-shaped recess 624' in an inner surface thereof corresponding to the shaft rod 614 of the first hinge member 61. Each recess 624' is exposed to a side of the rod 623 for allowing insertion of the shaft rod 614 therein thereby providing pivotal connection between the first hinge member 61 and the second hinge member 62.

Each ear 22 of the supporting plate 2 defines a vertical slot 222' communicating with the engaging slot 221. Each vertical slot 222' is exposed to a top surface of the corresponding ear 22 for allowing the first engaging pin 621 of the second hinge member 62 to be snappingly received in the engaging slot 221 thereby providing a sliding connection between the second hinge member 62 and the supporting plate 2. The vertical slot 222' forms a pair of outwardly inclined surfaces (not labeled) for facilitating movement of the first engaging pin 621 therethrough.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

I claim:

1. A keyswitch device, comprising:

a keycap;

a supporting plate arranged below the keycap;

a first hinge member including a first engaging portion engaged with the keycap and a second engaging portion securely attached to the supporting plate, the first engaging portion being inclined to the second engaging portion and being resiliently deflectable relative to the second engaging portion;

a second hinge member pivotally connected between the supporting plate and the keycap; and a switching means for conducting a switching action due to movement of the keycap actuated upon depression thereof.

2. The keyswitch device as claimed in claim 1, wherein the second engaging portion of the first hinge member includes a planar portion defining an engaging hole, and wherein the supporting plate includes a tag defining an aperture and a tab opposite the tag, the planar portion extending into the aperture of the tag and the tab engaging with the engaging hole thereby securely attaching the planar portion to the supporting plate.

3. The keyswitch device as claimed in claim 2, wherein a groove with an inclined inner surface formed therein is defined in an edge of the planar portion for facilitating engagement between the tab and the engaging hole.

4. The keyswitch device as claimed in claim 2, wherein the tag is formed by stamping and bending the supporting plate.

5. The keyswitch device as claimed in claim 2, wherein the tab is formed by stamping and bending the supporting plate.

6. The keyswitch device as claimed in claim 1, wherein the first engaging portion of the first hinge member includes a pair of engaging rods, and wherein the keycap includes a pair of retention slots exposed to an end thereof.

7. The keyswitch device as claimed in claim 6, wherein the second hinge member includes a pair of second engaging rods, and wherein the keycap includes a pair of round recesses, the second engaging rods pivotally engaging with the round recesses.

8. The keyswitch device as claimed in claim 1, wherein the first hinge member includes a pair of plates, each of the plates forming a shaft rod on an outer surface thereof, and wherein the second hinge member includes a pair of parallel rods, each of the parallel rods defining a round hole in an inner surface thereof, the shaft rods pivotally engaging with the round holes.

9. The keyswitch device as claimed in claim 1, wherein the first hinge member includes a pair of plates, each of the plates forming a shaft rod on an outer surface thereof, and wherein the second hinge member includes a pair of parallel rods, each of the parallel rods defining an L-shaped recess in an inner surface thereof, the L-shaped recess being exposed to a side of each of the shaft rods for allowing insertion of each of the shaft rods therein.

10. The keyswitch device as claimed in claim 1, wherein the supporting plate includes a pair of ears each defining an engaging slot, and wherein the second hinge member includes a pair of first engaging pins, the first engaging pins being slidably received in the slots.

11. The keyswitch device as claimed in claim 10, wherein each of the ears defines a vertical slot communicating with each of the engaging slots, one end of the vertical slot of each of the ears being exposed to a top surface of each of the ears for allowing each of the first engaging pins to be snappingly received in each of the engaging slots thereby providing sliding connection between the second hinge member and the supporting plate.

12. The keyswitch device as claimed in claim 11, wherein the vertical slot of each of the ears forms outwardly inclined surfaces for facilitating movement of each of the first engaging pins therethough.

13. The keyswitch device as claimed in claim 11, wherein the ears are formed by stamping and bending the supporting plate.

14. The keyswitch device as claimed in claim 1, wherein the switching means includes a base plate forming a rubber spring thereon and a flexible circuit board forming a fixed electrode thereon, the rubber spring having a movable electrode opposite the fixed electrode.

15. The keyswitch device as claimed in claim 14, wherein a post downwardly extends from a bottom surface of the keycap for pressing against the rubber spring.

* * * * *